US006722752B2

(12) United States Patent
Davis et al.

(10) Patent No.: US 6,722,752 B2
(45) Date of Patent: Apr. 20, 2004

(54) PEN MAINTENANCE SYSTEM AND METHOD FOR OPERATING SAME

(75) Inventors: Jeremy A. Davis, Battle Ground, WA (US); David J. Waller, Vancouver, WA (US); Kit L. Harper, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 33 days.

(21) Appl. No.: 10/237,274

(22) Filed: Sep. 4, 2002

(65) Prior Publication Data

US 2004/0041871 A1 Mar. 4, 2004

(51) Int. Cl.[7] ..... B41J 29/393
(52) U.S. Cl. ..... 347/19
(58) Field of Search ..... 347/19, 23, 5, 347/17, 35, 36, 38, 7, 6, 29, 30, 32, 10, 11, 12, 28, 33, 77, 85, 86, 87; 395/900

(56) References Cited

U.S. PATENT DOCUMENTS 4,107,699 A 8/1978 Kenworthy
5,428,378 A 6/1995 Murata et al.
5,489,925 A * 2/1996 Brooks et al. ..... 347/6
6,036,296 A * 3/2000 Axtell et al. ..... 347/7
6,123,409 A 9/2000 Wolf
6,132,026 A 10/2000 Taylor et al.
6,145,958 A 11/2000 Medin et al.
6,158,838 A 12/2000 Capurso
6,213,583 B1 4/2001 Therien
6,224,186 B1 5/2001 Johnson et al.
6,234,620 B1 5/2001 Faisst, Jr. et al.
6,273,547 B1 8/2001 Aldrich
6,281,911 B1 8/2001 Nakazawa et al.
6,340,220 B1 1/2002 Gaylor et al.

FOREIGN PATENT DOCUMENTS

JP 59045163 3/1984
JP 59209876 11/1984

* cited by examiner

*Primary Examiner*—Stephen D. Meier
*Assistant Examiner*—Charles Stewart, Jr.

(57) ABSTRACT

A pen having a printhead and a chamber for holding ink; a sensor for monitoring changes in the amount of ink in the chamber; and a pump for seletively drawing ink into or expelling ink from the chamber.

8 Claims, 3 Drawing Sheets

PEN MAINTENANCE SYSTEM AND METHOD FOR OPERATING SAME

BACKGROUND

As ink leaves the reservoir chamber of an inkjet pen, such as when the pen is being used for a print job, or due to evaporation or printhead servicing, air can accumulate in the chamber to replace lost volume. The loss of ink from a printhead and the accompanying accumulation of air can lead to several printhead quality problems that may degrade the quality of the print job. These problems include changes in back pressure in the chamber as a result of environmental changes, and nozzle de-priming. With disposable pen sets, most of the problems associated with loss of ink from the printhead are manageable since the pen is discarded or recycled rather than being maintained for the life of the printer. However, many printers and other hardcopy devices utilize permanent pen sets. Permanent pen sets rely upon an ink supply reservoir fluidly connected to the pen to replenish ink as it is expelled through the printhead. But even when ink supply reservoirs are used, air accumulation is a concern since the quality of the printhead must be maintained throughout the life of the printer, and exposure of the ink to air can have an adverse impact on the ink and therefore the printhead.

Inkjet pens require regular servicing in order to maintain the pens and the quality of print jobs. This is especially true of printers and other hard copy apparatus that use permanent pen sets. Although there are many types of servicing systems and service stations, printhead servicing does not address the problems associated with accumulation of air inside the ink reservoir.

SUMMARY

A pen having a printhead and a chamber for holding ink; a sensor for monitoring changes in the amount of ink in the chamber; and a pump for selectively drawing ink into or expelling ink from the chamber.

DETAILED DESCRIPTION OF PREFERRED EMBODIMENTS

Figure 1:
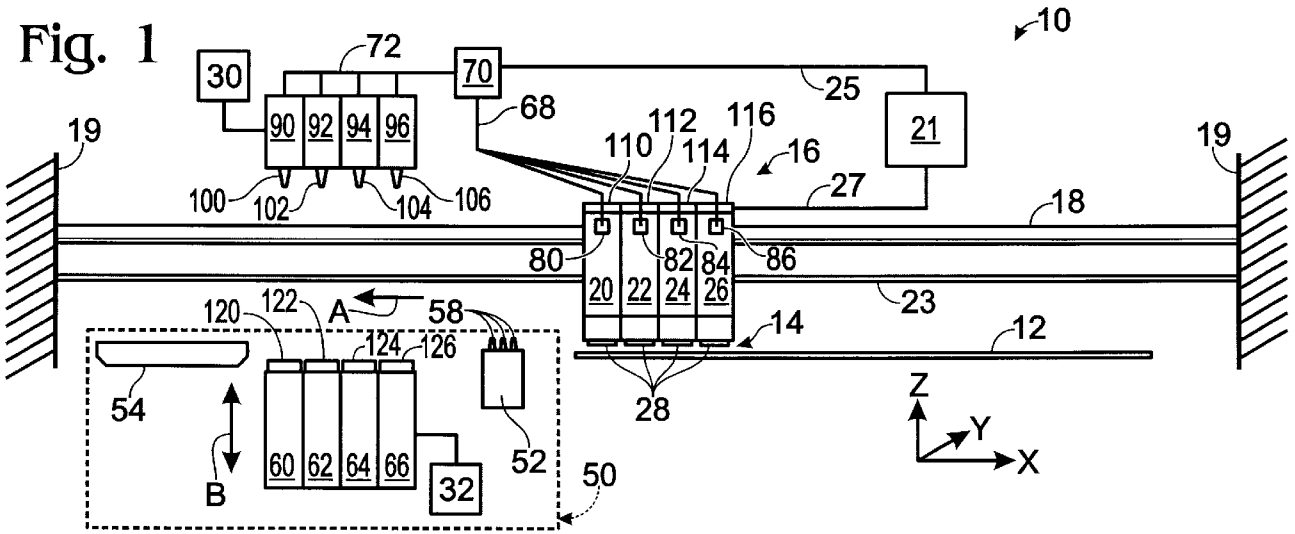
FIG. 1 is a schematic front view of selected components of an inkjet printer according to an illustrated embodiment of the present invention, illustrating the inkjet pens laterally adjacent the ink supply and with the pens positioned as they would be during printing operations.

Many hardcopy devices that rely upon inkjet printers include service stations for maintaining the quality of the printheads, and thus assure the quality of the print jobs. A schematic representation of an inkjet printer according to an illustrated embodiment of the present invention is shown in the drawings. It will be appreciated that like reference numerals are used throughout the specification to identify like structural features found in more than one drawing figure.

The inkjet printer 10 depicts in a highly schematic manner an embodiment of an inkjet hard copy apparatus, in this case, a computer peripheral, color printer. It will be appreciated that printer 10 includes numerous electrical and mechanical operating mechanisms that are necessary to operate the printer, but not needed to illustrate the components described herein. As such, many electrical and mechanical operating mechanisms are omitted from the drawings. Operation of inkjet printer 10 is administrated by an internal electronic controller 70 , which is usually a microprocessor or application specific integrated circuit ("ASIC") controlled printed circuit board connected by appropriate cabling to the computer. Imaging, printing, print media handling, control functions, and logic are executed with firmware or software instructions for microprocessors or ASICs. Print media 12 (referred to generically herein simply as "paper," regardless of actual medium selected by the end-user, for example, cut sheet or roll stock, etc.) is loaded by the end-user onto an input tray (not shown). Sheets of paper are then sequentially fed by a suitable, internal, paper-path transport mechanism to a printing station that defines a printzone 14 where graphical images or alphanumeric text are created using color imaging and text rendering techniques. In FIG. 1, printzone 14 is defined generally as the area beneath the inkjet pens 20, 22, 24, and 26 where ink is applied to the paper 12.

A carriage 16 mounted on a shaft 18 that has its opposite ends mounted to printer chassis 19 supports in an operative position relative to paper 12 a set of four inkjet writing instruments, known as pens and referred to herein as pens and/or inkjet pens, and labeled 20, 22, 24, and 26, respectively. Fewer pens or more pens may be used in different printers. As detailed below, each of the inkjet pens 20 through 26 includes an internal ink reservoir or chamber for holding ink, and has a printhead 28 on the lower side of the pen facing the printzone 14. Each printhead is adapted for expelling minute droplets of ink or other fluids to form dots on adjacently positioned paper 12 in the printzone 14. Each printhead 28 generally consists of a drop generator mechanism and a number of columns of ink drop firing nozzles. Each column or selected subset of nozzles selectively fires ink droplets, each droplet typically being only a tiny liquid volume, that are used to create a predetermined print matrix of dots on the adjacently positioned paper as the pen is scanned across the media. A given nozzle of the printhead is used to address a given matrix column print position on the paper. Horizontal positions, matrix pixel rows, on the paper are addressed by repeatedly firing a given nozzle at matrix row print positions as the pen is scanned across the paper. Thus, a single sweep scan of the pen across the paper can print a swath of dots. The paper is advanced incrementally relative to the inkjet printheads to permit a series of contiguous swaths.

Inkjet printer 10 is shown as a full color inkjet system and therefore includes inks for the subtractive primary colors, cyan, yellow, magenta (CYM) and a true black (K). By way of example, pen 20 contains cyan, pen 22 yellow, pen 24 magenta, and pen 26 black. Additive primary colors—red, blue, green—or other colorants may of course be used. While the illustrated color pens 20, 22, and 24 each contain a dye-based ink, other types of inks may also be used, such as paraffin-based inks, as well as hybrid or composite inks having both dye and pigment characteristics.

Carriage 16 and thus pens 20, 22, 24 and 26 are mounted on shaft 18 for shuttle-type reciprocating movement over media 12. Shaft 18 and carriage 16 are mounted on a printer chassis 19. A carriage motor 21, typically a servo motor that is connected via circuitry 25 to controller 70 and to carriage 16 with a drive belt 27 (illustrated schematically), moves carriage 16 during printing in a back and forth direction transverse to the direction of media advancement through the printzone 14. It is common in the art to refer to the pen scanning direction as the x-axis, the paper feed direction through the printzone as the y-axis, and the ink drop firing direction as the z-axis. That convention is used herein.

As noted, carriage 16 is under the control of the printer controller 70. The position of carriage 16 relative to paper 12 in the direction along the x-axis is determined by way of an encoder strip 23 that has its opposite ends mounted to the printer chassis 19. The encoder strip 23 extends past and in close proximity to an encoder or optical sensor carried on carriage 16 to thereby signal to the printer controller the position of the carriage assembly relative to the encoder strip.

The paper 12 is incrementally advanced through the printzone 14 by a paper transport mechanism between swaths of the pens. An encoder, typically a disk encoder, and associated servo systems are one of the methods often employed for controlling the precise incremental advance of the media. This incremental advance is commonly called "linefeed." Precise control of the amount of the advance, the linefeed distance, contributes to high print quality. The paper advance mechanisms must move the paper 12 through the printzone 14 the desired distance with each incremental advance, at the desired rate, and so that the paper is oriented correctly relative to the printheads 28.

A service station shown generally and schematically at 50 services the printheads 28 associated with each of the pens 20, 22, 24 and 26. Service station 50 (shown in dashed lines in FIGS. 1 and 2) includes three primary components, a pen wiper station 52, a spittoon 54, both of which are optional, and printhead seal members 120, 122, 124 and 126. As described below, printhead seal members 120 through 126 are components of the ink supply reservoirs (also referenced herein as "ink reservoirs") 60, 62, 64 and 66. Wiper station 52 is positioned relative to pens 20 through 26 such that when the printer controller 70 causes carriage 16 to move along the x-axis in the direction indicated with arrow A, the printheads 28 are dragged across wiper blades 58 (three of which are illustrated) to clean the printheads. The wiper blades physically scrape ink and contaminants off the printheads. Wiper station 52 may be either stationary, or may be configured to move into and out of an operative position, by movement with an actuating mechanism in the direction along either the z or y-axes, or both.

Spittoon 54 is a hollow container into which ink is spit when necessary. When spitting service is needed, carriage 16 is shuttled on shaft 18 along the x-axis until pens 20 through 26 are positioned above the spittoon 54. The carriage is temporarily parked at this position while one or more of the pens spit ink into the underlying spittoon; firing the nozzles in the pens spits ink. The spittoon 54 is a repository that holds waste ink spit out of the pens. The ink in the spittoon dries, or partially dries, and an absorbent pad or similar material may be incorporated into the spittoon to manage and control waste ink that accumulates in the spittoon.

Once spitting is complete, carriage 16 is again put into service printing, or if printing is complete, is shuttled in the direction of arrow A until the pens are in an operative position above printhead seal members 120 through 126 as described below.

As ink is selectively expelled through printheads 28, whether on paper 12, by spitting into the spittoon 54 or otherwise, the amount of ink in the reservoirs in the pens decreases. As the volume of ink in the pen decreases, there may be some accumulation of air in the pen reservoir, resulting in print quality problems.

In the embodiment of the invention as illustrated, the ink supply main reservoirs 60, 62, 64 and 66 may be used as components of the service station 50 in combination with a printhead pressure system described below. That is, as detailed below, the ink supply reservoirs 60–66 may be used to supply ink directly to, and optionally receive ink directly from the printheads. It will be understood that the embodiment of the invention illustrated in the figures may include in addition to the reservoirs 60 through 66, secondary ink supply reservoirs, although such secondary supply reservoirs are not illustrated.

Figure 3:
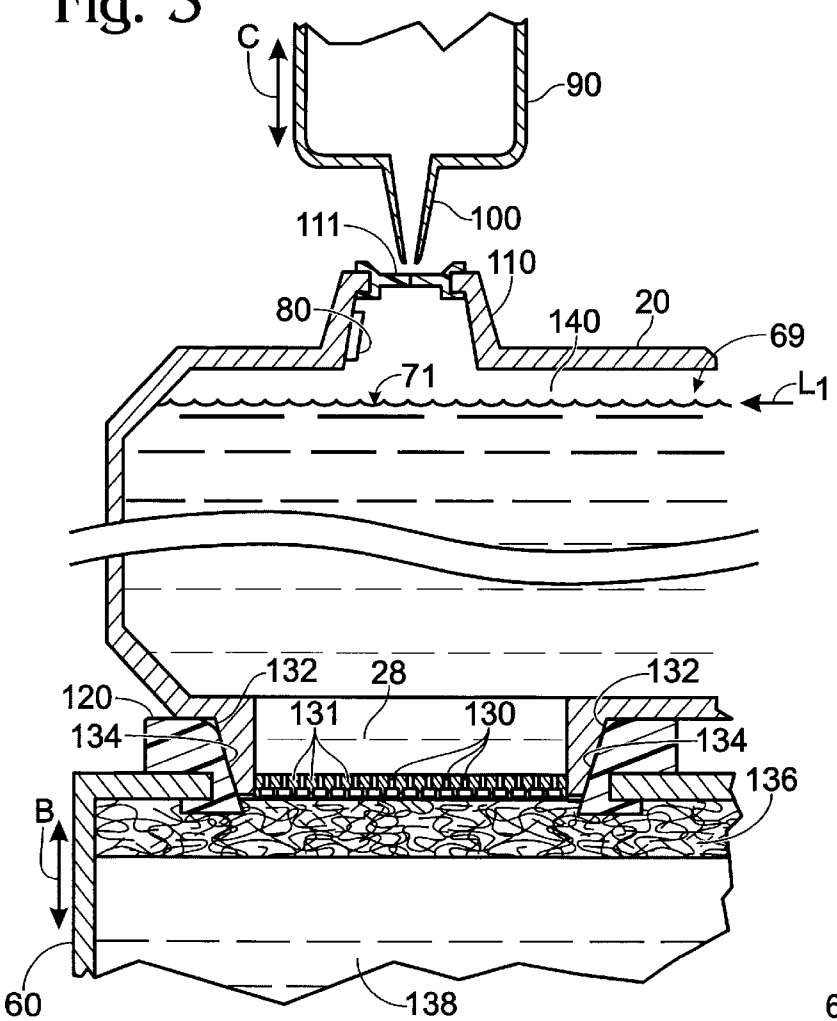
FIG. 3 is a schematic, partial fragmentary cross sectional view of one of the inkjet pens shown in FIG. 2, parked at a service station, and taken at the close up circle 4 in FIG. 2.

Each pen 20–26 includes a sensor, labeled 80, 82, 84 and 86, respectively, each of which is coupled to printer controller 70 with appropriate circuitry 68. Controller 70 likewise is connected with circuitry 72 to air pumps 90, 92, 94 and 96, which as detailed below may be fluidly coupled directly to pens 20, 22, 24 and 26, respectively, to perform pen and nozzle maintenance functions. Controller 70 may be a component of the printer control system already in place in the printer. Each of the sensors 80 through 86 is a sensor for sensing and monitoring the amount of ink 71 (FIGS. 3, 4, and 5) in pens 20–26, respectively. Sensing and monitoring the amount of ink 71 may be accomplished in any one of several ways. With reference now to FIG. 3, each pen 20–26 defines an ink internal chamber 69 (FIG. 3) that is an ink reservoir for ink 71. Although only pen 20 is shown and described with reference to FIGS. 3, 4, and 5, it is to be understood that the description of the structure of pen 20 also applies to pens 22, 24, and 26. The sensors 80 through 86 may be configured for detecting pressure changes in the pen's internal chamber, for example by comparing a measured chamber pressure value to a predetermined pressure value that is represented as a predetermined value which is stored in controller 70. Although only sensor 80 is shown and described with reference to FIGS. 3, 4, and 5, it is to be understood that the description of the structure of sensor 80 also applies to sensors 82, 84, and 86. Alternately, the sensors 80 through 86 may be configured for measuring the pressure in chamber 69. As yet another alternative, sensors 80 though 86 may be configured to detect the level of ink 71 in the chamber 69 and to detect changes in the level of ink.

Figure 2:
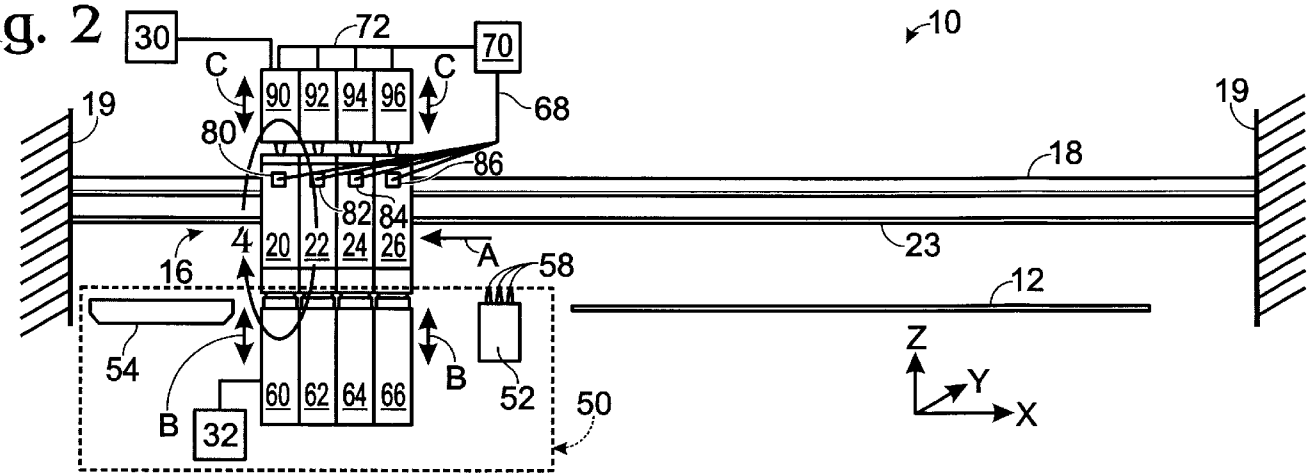
FIG. 2 is a schematic front view of the inkjet printer shown in FIG. 1 with the inkjet pens parked in the service station.

With reference to FIG. 1, air pumps 90 through 96 comprise pressure devices of any appropriate type, including for example plunger pumps that are capable of creating either positive or negative pressure changes in pens 20–26. Stated otherwise, the purpose of pumps 90 through 96 is for causing fluid to be selectively drawn into or expelled from pens 20–26. Each air pump 90 through 96 is fitted with a fluid conduit (labeled 100 through 106 in FIG. 1) that is configured to couple with and fluidly seal to a valve seat (labeled 110 through 116, respectively) on the pens 20 through 26, respectively. As may be seen in FIG. 2, and as will be detailed below, when controller 70 receives a signal via circuitry 68 from one of the sensors 80 through 86 indicating that one or more of the pens 20 through 26 requires servicing, or when pen servicing is otherwise indicated, then the air pumps 90 through 96 are fluidly connected to the corresponding pens 20 through 26 as shown in FIG. 2 and as described hereinafter to establish an appropriate internal pressure in each pen. Although the illustrated embodiment includes four pumps 90 through 96, one pump may be used with appropriate plumbing and valve connections so that only one pump is independently connected to all of the pens, and is capable of selectively manipulating the pressure in the pens either one at a time, or simultaneously in groups of more than one. Similarly, each of the one or more pumps may be fluidly connected to the pens with tubing that communicates with the headspace in the pen rather than through a selectively connectable fluid conduit as shown.

With reference now to FIG. 3, pump 90 includes a fluid conduit 100 that aligns with valve seat 110 on pen 20. Valve seat 110 includes a sealing member 111 such as a flexible gasket that is closed to the atmosphere when fluid conduit 100 is disengaged from the pen to thereby provide a fluid tight environment in chamber 69. It will be appreciated that the fluid conduit and valve seat illustrated herein are exemplary only and that any number of acceptable valve seat arrangements may be utilized.

When pens 20 through 26 are being serviced and/or stored, the pens are moved into a position adjacent the air pumps such that the fluid conduits align with the valve seats. An actuating system 30, shown schematically in FIGS. 1 and 2, but understood to include driving means such as a motor and appropriate linkages, is provided to move pumps 90 through 96 into and out of fluid coupling engagement with the pens 20 through 26 in the directions indicated with the arrows C in FIGS. 2 and 3 to allow fluid conduit 100 to engage and disengage sealing member 111. At the same time, the printheads 28 are brought into contact with printhead seal members 120, 122, 124 and 126 on ink supply reservoirs 60, 62, 64 and 66, respectively. Specifically, the ink supply reservoirs 60 through 66 are moved into a sealing engagement such that the printhead seal members 120 through 126 seal around the printheads 28. An actuating system 32, again shown schematically in FIGS. 1 and 2, but which is understood to include appropriate driving means and linkage, is provided to move the ink supply reservoirs 60 through 66 into a sealing engagement with the printheads 28 on pens 20 through 26, respectively, in the directions indicated with the arrows B in FIGS. 2 and 3.

With reference now to FIG. 3, each ink supply main reservoir 60 through 66 includes a printhead seal member 120, 122, 124 and 126, respectively, on the upper surface of the reservoir ("upper surface" referring to the surface of the reservoir facing pens 20 through 26). The printhead seal members 120 through 126 are elastomeric capping members—typically fabricated of nitrile rubbers, elastomeric silicones, ethylene polypropylene diene monomer (EPDM) and equivalent compounds—that are configured to engage a respective one of the printheads 28 on the pens 20 through 26 to provide a fluid seal with the printheads.

Figure 4:
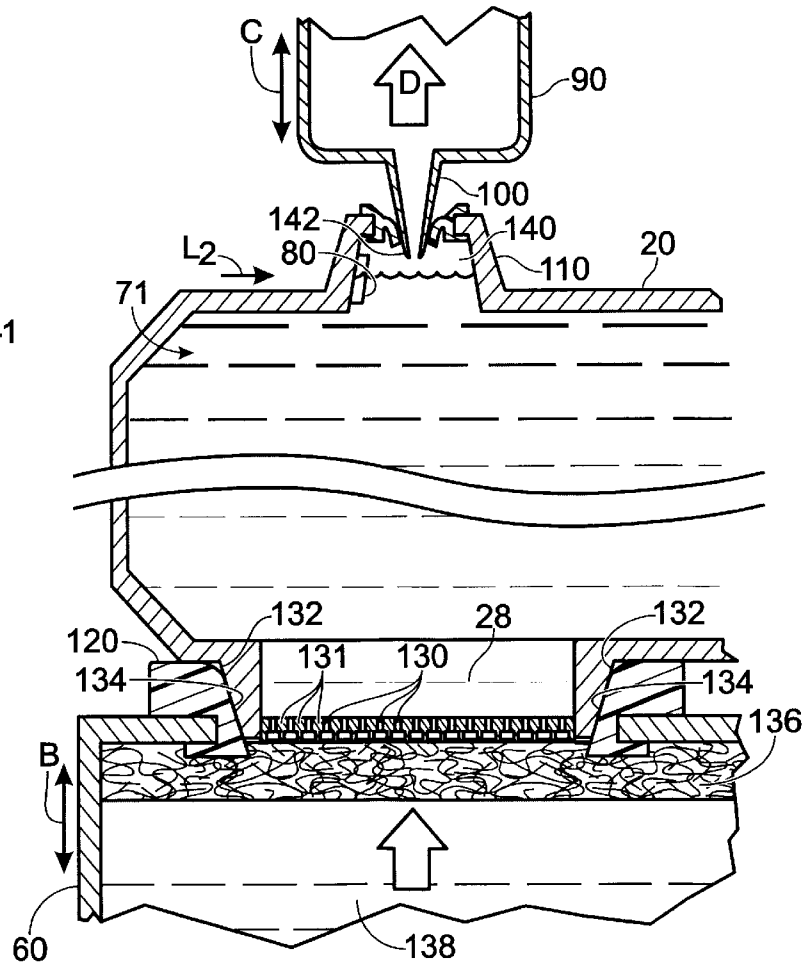
FIG. 4 is a schematic, partial fragmentary cross sectional view of a single inkjet pen similar to the pen shown in FIG. 3, except illustrating a pump connected to the pen.

A single pen, ink supply reservoir and printhead seal, and air pump are illustrated in FIGS. 3 and 4, in this case, pen 20 and the components associated therewith. Pen 20 is schematically illustrated as defining a hollow ink-holding reservoir, internal chamber 69, for holding a supply of ink 71 that is expelled through printhead 28. Printhead 28 is illustrated schematically for the sake of simplicity, and is understood to be under the control of a controller such as controller 70. Printhead 28 includes a drop generator 131 such as a thin film resister that causes ink to be expelled in a controlled manner through a number of ink drop firing nozzles 130. The outer wall of pen 20 defines an outer peripheral wall 132 that borders and surrounds printhead 28. The outer surfaces of peripheral wall 132 are configured to form a seal with complementary wall surfaces of printhead seal member 120. One such arrangement is shown in FIG. 3 where the outer surfaces of peripheral wall 132 slope or taper inwardly, and the outer mating surfaces of the printhead seal members slope or taper correspondingly and in a complementary manner so that the respective walls 132, 134 mate to one another and form a seal therebetween.

Referring specifically to FIG. 3, printhead seal member 120 is located atop ink supply reservoir 60 and defines a capping member having interior wall surfaces that are cooperatively shaped to engage the corresponding outer peripheral wall 132 of pen 20. Thus, the inward-facing surfaces of member 120 define a downwardly sloping wall 134 that tapers inwardly and which is configured at an angle that is complimentary to the taper of outer peripheral wall 132 of pen 20 such that when the supply reservoir 60 is moved into the position where the seal member 120 engages pen 20, as shown in FIGS. 3 and 4, a fluid-tight seal is formed between the pen 20 and the printhead seal member 120. A filter 136 is positioned within reservoir 60 so that the filter may be in contact with the supply of ink 138 in reservoir 60 to maintain the filter in a wetted condition. The printer controller 70 and actuator 32 cooperate to move reservoir 60 in the direction indicated by arrows B in order to move the reservoir 60 into a sealing relationship between the printhead seal member 120 and the printhead 28 as shown.

Ink supply reservoirs 60 through 66 are preferably continuously maintained in a condition such that filters 136 are generally wetted with ink 71. Wetting the filters may be accomplished in several ways, for example by providing a secondary source of ink supply for each reservoir, or by pressurizing the reservoirs, or by spitting ink from pen 20 through printhead 28 when pen 20 is engaged to reservoir 60.

As noted earlier, when ink 71 has been expelled from pen 20 the fluid level of ink 71 in the pen 20 drops and air may accumulate in the chamber 69 to replace the volume lost due to loss of ink 71. The loss of ink 71 from chamber 69 is shown in FIG. 3, where there is an air headspace 140 defined at the upper portion of internal chamber 69. The difference in the levels of ink 71 in chamber 69 is illustrated with line L1 in FIG. 3 and L2 in FIG. 4, each of which indicates the upper fluid level of ink 71 in chamber 69.

As the fluid level in the pen 20 drops, for example from the level L2 in FIG. 4 to the level L1 in FIG. 3, there is an accompanying change in the internal pressure within the pen, including a change in the air pressure in headspace 140 and a change in the hydrostatic pressure in the ink 71. As described above, sensor 80, shown and located schematically in valve seat 110, is calibrated to monitor and/or detect the amount of ink in chamber 69, for example by detecting changes in the internal pressure in the pen and transmitting those data to controller 70. While sensors 80 through 86 illustrated in the figures are for detecting air pressure in headspace 140, sensors 80 through 86 may be of the type for measuring hydrostatic pressure as well, or both air pressure and hydrostatic pressure. In any event, when the pressure in pen 20 reaches a predetermined level as sensed by sensors 80 through 86, controller 70 initiates a pen servicing routine during which the ink supply in pen 20 will be either recharged, or during which ink 71 will be spit from the pen 20. For example, when the level of ink 71 in chamber 69 in pen 20 decreases there is an accompanying pressure change that will be detected by sensor 80. It will be appreciated that the term "pressure change" as used herein means a pressure that differs from a previously determined pressure. This change in pressure, whether air pressure or hydrostatic pressure, is used by controller 70 to determine whether servicing is needed.

For example, a predetermined pressure value for initiating servicing for pen 20 may be stored in controller 70. Pressure values detected by sensor 80 are transmitted to controller 70 through circuitry 68 on either an ongoing or intermittent basis. The detected pressure values are compared with the predetermined pressure value in controller 70. When the difference between the detected pressure value in chamber 69, as detected by sensor 80, reaches a predetermined difference from the predetermined pressure value, controller 70 causes carriage 16 to be moved laterally away from printzone 14 (optionally over wiper 52 to clean nozzles 130) and into position relative to pumps 90 through 96 and ink supply reservoirs 60 through 66 so that the fluid conduits 100 through 106 align with the corresponding valve seats 110 through 116 so that the pumps 90 through 96 may be selectively placed in fluid communication with the chambers 69 in pens 20 through 26. The ink supply reservoirs 60 through 66 are then moved toward the printheads (arrow B, FIG. 3) via actuator 32 and the pumps 90 through 96 are moved toward the pens 20 through 26 (arrow C, FIG. 4). As the pumps 90 through 96 are moved toward the valve seats 110, the fluid conduits 100 are inserted into the valve seats 110 and fluidly seal thereto with the valve seats 110 sealing to the fluid conduits 100 and acting as a fluid-tight septum. Referring to FIG. 4, the pump is moved toward pen 20 until the distal end 142 of fluid conduit 100 is positioned in headspace 140 within valve seat 110.

Alternately, a predetermined absolute pressure value for initiating servicing may be stored in controller 70. When the detected pressure value from sensor 80 equals or exceeds a predetermined pressure value for beginning servicing, controller 70 initiates servicing. Finally, as yet another alternative, sensors 80 through 86 may be of the type for measuring the fluid level of ink 71 in chamber 69. When the level of ink is determined to have reach a predetermined level (represented by a value stored in controller 70), then servicing is begun.

Pumps 90 through 96 are used to perform pen maintenance functions. Thus, the pumps may be used to increase the internal pressure in the pens to eject ink 71 through nozzles 130, or to decrease the internal pressure in the pens to cause ink 71 to flow through nozzles 130 and into chambers 69. With pen 20 connected to reservoir 60 and pump 90 as shown in FIG. 4, controller 70 causes pump 90 to begin operation to pump or withdraw air out of the pen from headspace 140, decreasing the air pressure in chamber 69, indicated with arrow D. Simultaneously, ink 138 contained in reservoir 60 is drawn through filter 136, through nozzles 130 and into the pen, recharging the pen. The recharging operation is allowed to continue until the internal pressure in pen 20 is detected by sensor 80 to be at a desired, predetermined value, at which point the controller 70 deactivates pump 90. As illustrated in FIG. 4, headspace 140 has been decreased in volume as the ink 71 in the pen has refilled—as indicated with line L2. With the pen filled to the desired volume, the pump may then be moved out of the engaging position with valve seat 110 as shown in FIG. 4 and back to the parked position illustrated in FIG. 3 until another print job is begun. When the fluid conduit 100 is withdrawn from the valve seat 110, seal 111 closes and forms an airtight seal.

Figure 5:
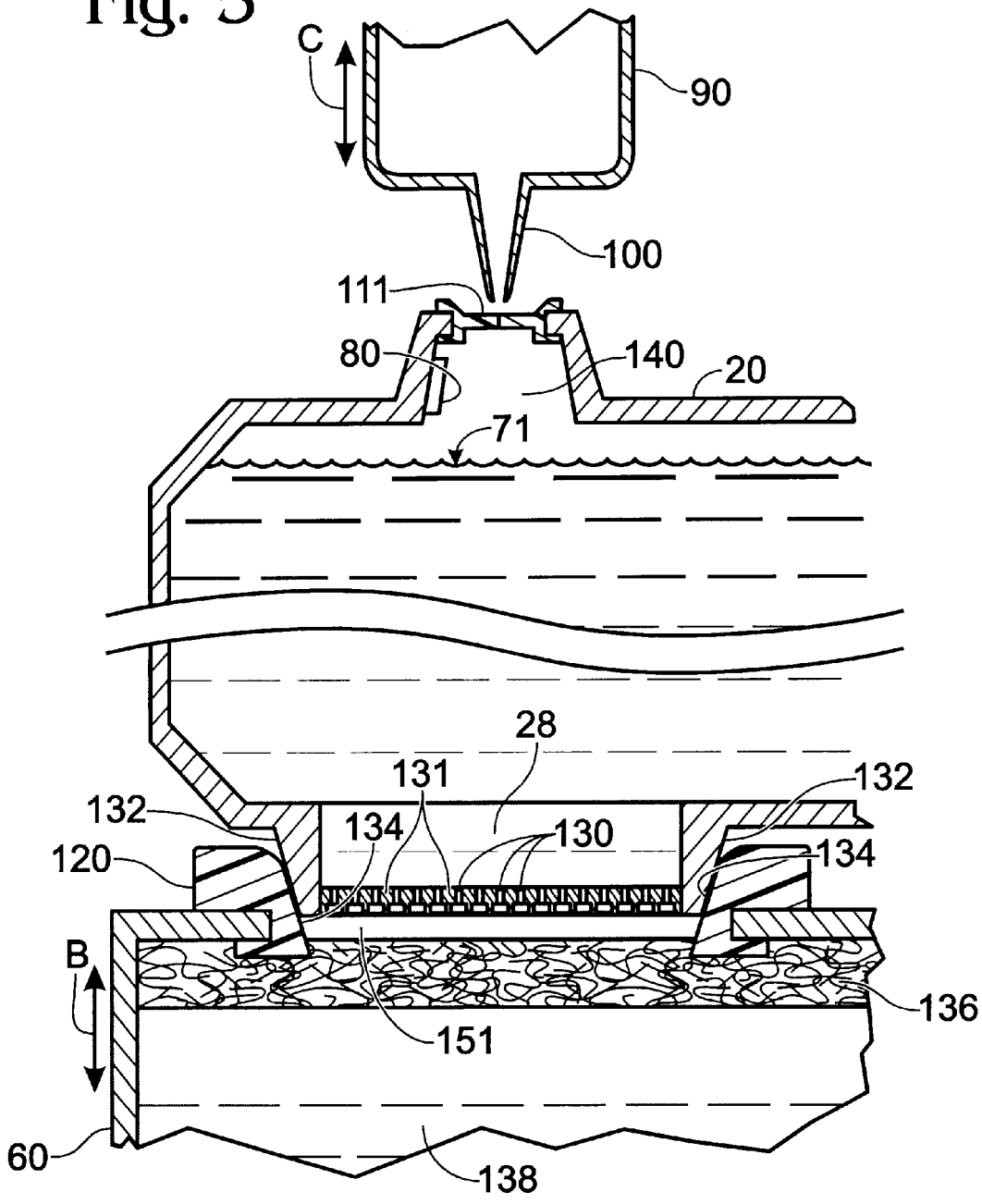
FIG. 5 is a schematic, partial fragmentary cross sectional view of a single inkjet pen as shown in FIGS. 3 and 4, illustrating the printhead nozzles separated from the underlying filter elements.

In addition to being used to decrease the air pressure in pen 20 to recharge the pen with ink 71, as described previously, pumps 90 through 96 may be utilized to perform other pen maintenance functions. For example, with continuing reference to FIGS. 3 and 4, when the printer controller 70 determines that one or more printheads 28 needs to spit ink to maintain nozzle health, carriage 16 is positioned relative to the ink supply reservoirs 60 through 66 so that the printheads 28 are aligned over the corresponding printhead seal members 120, 122, 124 and 126. Carriage motion is then stopped and the reservoirs are moved upwardly (arrow B in FIGS. 3 and 4) until the printhead seal members 110 are in the position shown in FIGS. 3 and 4. It should be noted that while in most instances the physical engagement between the printhead seal members and the corresponding printheads provides a sealed engagement therebetween as shown in FIGS. 3 and 4, spitting may be accomplished with the printheads 28 and printhead seal members 120 through 126 in close proximity to one another (as shown in FIG. 5) rather than in a sealed relationship.

With reference to FIG. 3, controller 70 then initiates nozzle maintenance in any one of a number of ways. First, ink may be spit by activating and "firing" the selected printhead nozzles 130, causing ink 71 to be expelled toward and into filter 136 and back into the reservoir. Contaminants carried by the ink or introduced from other sources are preferably captured by the filter 136 and are therefore preferably prevented from entering the ink supply 138. Spit ink is thus mixed with ink 138 residing in the supply reservoir 60 and is recycled since it is again available to be drawn back into the pen during refilling operations. The controller 70 is configured for initiating spitting for any one or more of the pens 20 through 26 on an individual basis, or for all of the pens 20 through 26 together. Referring to FIG. 4, ink 71 may also be ejected by engaging the pumps 90 through 96 with the valve seats 110 as described above and operating the pumps to create an increase in the pressure in headspace 140. This forces ink to "drool" through nozzles 130 and into filter 136.

There are numerous alternative structures and processing steps that may be utilized. With reference to FIG. 5, the ink supply reservoirs 60–66 may be used as the capping members during periods of printer inactivity. Thus, the pen 20 may be positioned relative to supply reservoir 60 such that a fluid-tight seal is formed between wall 132 of pen 20 and wall 134 of reservoir 60, yet nozzles 130 are held in a spaced apart relationship with filter 136 to define a gap 151 therebetween. Controller 70 is programmed to park the pen in this intermediate position so that the pen 20 is capped during storage. This capping arrangement maintains a desirable controlled environment for the nozzles 130 during storage. Specifically, when the pens 20 through 26 are in a sealing engagement with the seal members 120 through 126, which communicate with a large reservoir of ink such that the filters 136 are continuously wetted by ink 138, as shown and described, the tendency of ink thickening (by, for example, evaporation) is reduced. And during storage ink 71 may be unintentionally drooled from the printheads 28. When the printheads 28 are capped as described above with printhead seal members 120 through 126, drooled ink flows back into the filters 136 prior to flowing into the ink supply reservoirs 60 through 66 where it may be used to recharge the pens 20 through 26.

When controller 70 determines that spitting is necessary the pens 20 through 26 may be positioned over spittoon 54 rather than over reservoirs 60 through 66. Spitting is then initiated by, for example, causing the pressure in one or more of the chambers 69 in pens 20 through 26 to be increased as described above with one or more of the pumps 90 through 96, or by firing nozzles 130. Once spitting is complete, the pens 20 may then be used for continued printing, or moved into a storage position such as just described, or to a capping member. Further, additional reservoirs for spit ink may be supplied with appropriate filters to remove clogs and the like. The additional reservoirs may include apparatus having fluid conduits for transferring cleaned ink back to the main ink supply reservoirs 60–66.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A pen maintenance apparatus, comprising:

a pen having an ink reservoir and sensor means for monitoring the amount of ink in the reservoir;

ink supply means for supplying ink to the pen; and means for modifying the pressure in the reservoir to selectively expel ink from the reservoir or to cause ink to enter the reservoir.

2. The pen maintenance apparatus according to claim 1 wherein the means for modifying pressure in the reservoir further comprises a pump.

3. The pen maintenance apparatus according to claim 2 wherein the pen includes nozzles, and wherein operation of the pump decreases the pressure in the reservoir to cause ink to flow from the ink supply means through the nozzles and into the reservoir.

4. The pen maintenance apparatus according to claim 2 wherein the pen includes nozzles, and wherein operation of the pump increases the pressure in the reservoir to cause ink to flow through the nozzles and out of the reservoir.

5. A pen maintenance system, comprising:

a pen having a printhead and an ink chamber;

a sensor for monitoring the amount of ink in the ink chamber;

a pump for changing the pressure in the ink chamber;

an ink supply reservoir for providing ink to and receiving ink from the ink chamber; and a cap member having a seat configured to receive the printhead so as to define a seal between the printhead and the cap member.

6. The pen maintenance system according to claim 5 wherein the pen is selectively fluidly connectable to the ink supply reservoir and the pump is configured for altering the pressure in the ink chamber to either cause ink from the ink supply reservoir to flow into the ink chamber, or cause ink to flow from the ink chamber to the ink supply reservoir.

7. The pen maintenance system according to claim 5 including an actuator for selectively moving the pump into and out of fluid communication with the ink.

8. The pen maintenance system according to claim 7 including an actuator for selectively moving the ink supply reservoir into and out of fluid communication with the printhead.

* * * * *